US007214138B1

(12) United States Patent
Stivers et al.

(10) Patent No.: US 7,214,138 B1
(45) Date of Patent: May 8, 2007

(54) GOLF BALL FLIGHT MONITORING SYSTEM

(75) Inventors: Keith Stivers, Hayward, CA (US); Allan Epstein, Los Altos Hills, CA (US); Steve R. Lamb, Diablo, CA (US)

(73) Assignee: BGI Acquisition, LLC, Indianapolis, IN (US)

( * ) Notice: Subject to any disclaimer, the term of this patent is extended or adjusted under 35 U.S.C. 154(b) by 0 days.

(21) Appl. No.: 09/495,407

(22) Filed: Jan. 31, 2000

Related U.S. Application Data

(60) Provisional application No. 60/117,824, filed on Jan. 29, 1999.

(51) Int. Cl.
*A63B 69/36* (2006.01)
*A63B 57/00* (2006.01)

(52) U.S. Cl. ..... 473/199

(58) Field of Classification Search ..... 473/406, 473/407, 233, 266, 199, 200; 273/317.2
See application file for complete search history.

(56) References Cited

U.S. PATENT DOCUMENTS

| | | | | |
|---|---|---|---|---|
| 2,223,849 | A | 12/1940 | Fogler et al. | 283/1 |
| 3,016,812 | A | 1/1962 | Chatlain | 95/11 |
| 3,513,707 | A | 5/1970 | Russell et al. | 73/379 |
| 3,577,153 | A | 5/1971 | Yagi et al. | 178/7.2 |
| 4,005,261 | A | 1/1977 | Sato et al. | 178/6.8 |
| 4,063,259 | A | 12/1977 | Lynch et al. | 354/120 |
| 4,136,387 | A | 1/1979 | Sullivan et al. | 364/410 |
| 4,158,853 | A | 6/1979 | Sullivan et al. | 358/93 |
| 4,160,942 | A | 7/1979 | Lynch et al. | 350/120 |
| 4,163,941 | A | 8/1979 | Linn, Jr. | 324/178 |
| 4,168,510 | A | 9/1979 | Kaiser | 358/183 |
| 4,375,887 | A | 3/1983 | Lynch et al. | 273/32 H |
| 4,542,906 | A | 9/1985 | Takase et al. | 273/185 R |
| 4,695,888 | A | 9/1987 | Peterson | 358/213.13 |
| 4,695,891 | A | 9/1987 | Peterson | 358/213.13 |
| 4,713,686 | A | 12/1987 | Ozaki et al. | 358/107 |
| 5,067,719 | A * | 11/1991 | Mook | 473/200 |
| 5,101,268 | A | 3/1992 | Ohba | 358/88 |

(Continued)

FOREIGN PATENT DOCUMENTS

| | | |
|---|---|---|
| EP | 0 340 936 | 11/1989 |

(Continued)

OTHER PUBLICATIONS

Extrapolation: Information from answers.com (http://answers.com/extrapolation.*

(Continued)

*Primary Examiner*—Mark Sager
*Assistant Examiner*—Robert Mosser
(74) *Attorney, Agent, or Firm*—Ice Miller LLP

(57) ABSTRACT

A system is described for monitoring the swing path of a golf club head and for monitoring flight characteristics of a golf ball following impact. A processor utilizes data from spaced apart spaced sensor arrays in determining the club head speed and head angle of a golf club during the swing phase of the club. Image capture devices captures successive images of the ball after impact, and the system processor generates data reflecting ball flight characteristics based on a comparison of the images.

77 Claims, 7 Drawing Sheets

U.S. PATENT DOCUMENTS

| | | | | |
|---|---|---|---|---|
| 5,111,410 | A | 5/1992 | Nakayama et al. | 364/551.01 |
| 5,210,603 | A | 5/1993 | Sabin | 358/93 |
| 5,342,054 | A * | 8/1994 | Chang et al. | 273/186.1 |
| 5,471,383 | A | 11/1995 | Gobush et al. | 364/410 |
| 5,472,205 | A | 12/1995 | Bouton | 273/187.1 |
| 5,614,823 | A | 3/1997 | Katayama et al. | 324/178 |
| 5,638,300 | A | 6/1997 | Johnson | 364/551.01 |
| 5,651,741 | A | 7/1997 | Masutani et al. | 473/200 |
| 5,713,799 | A * | 2/1998 | Balmat | 473/200 |
| 5,797,805 | A * | 8/1998 | Lubell et al. | 473/266 |
| 5,803,823 | A * | 9/1998 | Gobush et al. | 473/223 |
| 5,823,878 | A | 10/1998 | Welch | 463/43 |
| 5,860,648 | A * | 1/1999 | Petermeier et al. | 273/108.2 |
| 5,904,484 | A * | 5/1999 | Burns | 434/252 |
| 5,907,819 | A | 5/1999 | Johnson | 702/152 |
| 6,042,483 | A | 3/2000 | Katayama | |
| 6,241,622 | B1 * | 6/2001 | Gobush et al. | 473/199 |
| 6,286,364 | B1 * | 9/2001 | Aoyama et al. | 73/65.03 |

FOREIGN PATENT DOCUMENTS

| | | |
|---|---|---|
| WO | WO 97/45177 | 12/1997 |

OTHER PUBLICATIONS

Web pages from visits on Feb. 19, 1999.

* cited by examiner

GOLF BALL FLIGHT MONITORING SYSTEM

PRIORITY

This application claims the benefit of priority to U.S. Provisional Patent Application No. 60/117,824, filed Jan. 29, 1999.

BACKGROUND OF THE INVENTION

1. Field of the Invention

The invention relates to a method and system for monitoring the flight of a golf ball after impact with a golf club head, and particularly to computer-controlled estimation of golf ball flight, impact timing and transfer efficiency characteristics.

2. Discussion of the Related Art

Golf swing and golf ball flight monitoring have been used as tools for golf instruction and for testing golf equipment such as golf clubs and golf balls for many years. Such details as club head angle and club speed at impact with the ball, as well as club take-away and downswing path, are known to be crucial in determining ultimately important ball flight characteristics, such as distance, direction, backspin and ball flight curvature after impact. However, a golf swing is simply too fast in real time for clear human observation of its many subtle features.

High speed cameras and/or other sensors have been used to sense and record data about the golf swing and/or initial ball flight characteristics. The data is often displayed for slow speed analysis of a golfer's form during the swing by an instructor and/or the golfer him or herself. The position of the golfer's shoulders, hips, legs and/or head, as well as his or her arms and hands, throughout the golf swing hive been captured on high speed still, video and televisions cameras either in a series of still frames or in videos or movies replayable in slow motion. Some such techniques are described, e.g., at U.S. Pat. Nos. 4,713,686, 5,111,410 and 5,210,603.

Besides capturing the data described above of the golfer's form, data of the path of the golf club head during the swing and initial characteristics of the golf ball in flight after impact with the club head are often used. These latter data are more often used for determining total ball flight characteristics such as distance, direction and curvature, rather than the golfer's form, and are arguably more relevant factors than form for determining the performance and effectiveness of a golfer's swing. Moreover, equipment such as the golf club and golf ball being used can be tested using these latter data, whereas the golfer's form really doesn't affect such performance of the golfer's equipment. Computer processors running software algorithms are often used for calculating or more of the above-mentioned features or others of the complete ball flight from the sensed and recorded data.

A series of United States patents assigned to Acushnet Company, makers of Titleist™ golf equipment show and describe various techniques and equipment for testing and determining golf club and golf ball performance using measured pre-impact and post-impact characteristics of the golf club and golf ball. These patents include U.S. Pat. Nos. 4,063,259, 4,136,387, 4,158,853, and 5,471,383.

For example, a pair of light source-photodetector pairs are positioned as described in the '259 patent at spaced-apart locations alongside the plane of the golfer's swing. Light emitted by each light source is received by its corresponding photodetector unless an object breaks the line of the emitted light to the detector. As the golf club head nears the golf ball in a test method according to the '259 patent, the club head swings through the line of sight of a first detector to the emitted light from its corresponding light source. When this happens, a signal is sent to a camera shutter to open. Just before the club head impacts the golf ball, a second line of sight of a second detector and its corresponding light source is broken. At this time, a second signal causes a xenon lamp to flash such that the reflected light is captured by the camera whose shutter was previously opened.

Next, a microphone captures the sound of impact of the golf club head with the golf ball. This acoustic signal is amplified and used as a trigger for a second xenon lamp to flash such that a post impact image of the golf ball is captured by the camera as shutter remains open. The same amplified acoustic signal is sent through a delay and is used as a trigger for a third xenon lamp to flash such that another image post-impact image of the golf ball in flight is captured by the camera. Shortly thereafter the shutter of the camera is closed, and a still frame having three images is stored on a film.

The use of a microphone to detect an acoustic signal requires setting up and maintaining of the microphone, as well as precise positioning and calibration separate from the optical components of the system. Also, the sound of impact of the particular golf ball and club at the test station where the microphone is being used has to be distinguished from other club-ball impacts going on in the vicinity of the microphone as well as from other sounds emanating from and around the test area. It is desired to have a golf ball flight monitoring system that does not use an acoustic photoflash trigger, and instead preferably uses all photosensitive equipment.

The film including the three temporally successive images of the golf ball reveals some useful initial characteristics of the flight of the golf ball. For example, the initial launch angle and velocity of the ball in the image plane can be respectively determined from the center of gravity positions of the successive images of the golf ball, and the known time duration between the capturing of the first and second or second and third images on the film.

A mark placed on the ball prior to performing the test can be used, as described at the '259 patent, to reveal the amount of backspin initially imparted to the ball by the club head. This initial backspin is determined based on how much the mark is observed to have rotated in the plane of the film from the first to the second and from the second to the third images of the ball captured on the film.

One way to find the backspin based on the captured images is to measure manually or by sight and experience the relative orientation of the mark between two successive images. Using the known timing between capture of the two images, the rate of backspin can be calculated. This procedure can consume a great deal of swing evaluation time and its accuracy is unreliable. Moreover, a calculation of such results of the backspin as loft during flight of the ball cannot be determined quickly as is desired during valuable swing evaluation time.

The small single mark described and shown in the '259 patent may not be visible if side spin causes the mark to rotate to the "dark" side of the ball, i.e., away from the camera side of the swing path. It is also difficult to distinguish the backspin from the sidespin imparted to the ball using the small single mark.

Lynch et al. were not concerned with sidespin in their description in the '259 patent because a mechanical golfer was used that presumably did not impart any sidespin to the ball at impact. Also, the mechanical golfer was presumed to hit the ball straight ahead with each test swing so that the initial direction of the golf ball was not considered as a factor in any of the tests described in the '259 patent. Moreover, it is understood that the '259 patent is drawn to equipment testing and not to analyzing swing characteristics of a golfer. Thus, such ball flight characteristics as the amount of fade or draw (or hook or slice, as the case may be) that a golfer is achieving due to the sidespin the golfer is imparting at impact, or the initial direction of the ball struck by the golfer, are not addressed in the '259 patent. It is desired to have a ball flight monitoring system and method that does determine ball flight characteristics based in part on the initial horizontal direction of the golf ball's flight and the initially imparted sidespin on the ball, in addition to the initial vertical flight conditions and backspin on the ball.

Each of the '387, '853 and '383 patents describes the use of one or more highly reflective or contrasting marks in the form of spots or dots on the golf ball for determining initial post-impact spin characteristics of the golf ball. Using subsequent images of the one or more spots, each of these patents sets forth some description of how to determine the complete spin characteristics of the golf ball, and not simply the backspin as discussed above with respect to the '259 patent. However, the one or more spots may again not be visible to the camera if they are rotated to the dark side of the ball when the image is captured on film. In addition, any dirt or scuff mark on the ball may not be distinguishable from the spots in a practical apparatus being used for multiple swings in the field.

The '387 and '853 patents disclose to position three cameras or photosensors each at ninety degree spaced locations around the golfer for detection of the mark or marks wherever they may turn around the golf ball. The three photosensors cannot be combined to achieve a single planar image of the initial flight of the ball and the data captured by the three photosensors is processed according to a complex algorithm that factors the rotationally spaced locations of the sensors. Also, the angular spacings of the sensors has to be very accurate or the calculated spin characteristics of the ball will be unreliable. It is desired to have a method and system for determining the complete initial spin characteristics of the golf ball without having to sense marks on the ball in more than a single observation plane.

The '383 patent sets forth a method for determining the total spin imparted to the golf ball using six highly reflective marks or spots on the ball and capturing their relative motions at successive temporal points within a single film frame. Data of the relative positions of the six marks as captured on the film is converted to data directly related to the total spin on the ball using a complex algorithm as described in the '383 patent. However, any one or all of the marks could again be rotated during a real golf swing to the dark side of the ball in which case the calculations would fail because the input data would be incomplete.

Gobush et al. are again concerned in the '383 patent with equipment testing, and not golf swing analysis, and thus the mechanical golfer used in the tests described in the '383 patent never imparts an amount of sidespin to the ball sufficient to cause any of the marks to rotate to the dark side of the ball before all of the camera images are captured. It is desired to have a system and techniques for determining total spin imparted to a golf ball notwithstanding the degree of sidespin on the ball.

The field of golf swing analysis is also understood in the present invention to be lacking systems and techniques that measure and/or determine or calculate and utilize data of the golf club head prior to impact with the ball in conjunction with initial flight characteristics. Such pre-impact club head data is desired, e.g., for determining energy transfer efficiency between the club and ball, whether any sidespin or horizontal ball directional characteristics are imparted by club head angle or swing path characteristics, and for obviating the need for acoustic sensing of impact for triggering image capture. It is also recognized in the present invention that such a desired system and techniques would be useful for golf swing analysis as well as for testing equipment, including such testing for determining the unique equipment specifications of particular golfers depending on their individual swing characteristics.

It is therefore an object of the invention to provide a golf ball flight and golf swing monitoring system and technique wherein pre-impact swing plane direction and head angle characteristics of the take away and downswing of the golf club are measured and analyzed.

It is a further object of the invention to have a system and technique for determining the total initial spin imparted to a golf ball, including backspin and sidespin, and also preferably the three-dimensional initial flight direction of the golf ball after impact with a golf club using a single frame including multiple temporally successive images.

It is also an object of the invention to have a golf ball flight and golf swing monitoring system and technique that combines pre-impact swing characteristics with initial flight conditions of the golf ball to determine transfer efficiency characteristics.

It is another object of the invention to provide a system and technique for monitoring and analyzing initial ball flight characteristics using a trigger for precisely timing the capture of temporally successive images.

SUMMARY OF THE INVENTION

In a first aspect of the invention, multiple temporally successive images of a golf ball after impact with a golf club are captured for comparison using a computer processor. The golf ball has a continuous and preferably linear or substantially linear marking on its surface that at least halfway circumambulates the golf ball such that the marking is apparent within each image. The backspin imparted to the golf ball by the impact with the golf club head is then calculable based on a comparison of the positions of the markings between two or more of the images. Preferably, a linear estimation of the markings at each image is first automatically determined by the processor. Then, the backspin on the golf ball in flight is calculated based on the relative angle or angles between the markings on the two or more images. The sidespin is preferably calculated based on the curvature of at least one of the markings.

In a second aspect of the invention, one or more photosensors are positioned a known distance before the impact position or the golf club with the ball. Preferably, two spaced-apart sensors are positioned before the impact position and the timing between the successive blocking of the two sensors is used to calculate the club speed prior to impact. The timing of the flash of the lamp and/or the triggering of the camera shutter is determined based on the calculated club speed, such that the ball is optimally positioned within the viewing range of the camera. Preferably, when a light signal received by at least one of the photosensors is blocked by the golf club, a trigger signal is sent to a flight capture device including a camera and at least one flashlamp that flashes a predetermined time or times after receiving the trigger signal for capturing an image of the ball after impact by a camera detector. Also preferably, each of a shutter on the camera and three flashlamps are timed from the receipt of the trigger signal for capturing multiple images in a frame such as on a film or a digital image capturing device.

In a third aspect of the invention, multiple images of the golf ball after impact with the golf club are captured by a camera preferably as described above. The computer processor automatically determines the three-dimensional spatial position, preferably based on a calculation and comparison of the diameters of two or more images of the golf ball. Based on the automatically determined three-dimensional spatial positions, preferably based on the calculated diameters of the two or more images, preferably as well as other factors such as relative positions of the golf ball with respect to the camera center at the time the images are captured, the processor determines the three-dimensional velocity of the ball including the velocity component of the ball into or out of the image plane.

In a fourth aspect of the invention, two spaced-apart sensors are positioned before the impact position and the timing between the successive blocking of the two sensors is used to calculate the club speed prior to impact. In addition, multiple images of the golf ball after impact with the golf club are captured by a camera preferably as described above. The transfer efficiency of a golf club with the golf ball is calculated, preferably for later comparison with other transfer efficiencies calculated before or after the instant one, including the translational and rotational kinetic energy based on the three-dimensional velocity, backspin and sidespin determined preferably as described above. The transfer efficiency may take into account the gravitational potential energy of the golf ball at the image positions. The relative transfer efficiency of multiple impacts, e.g., using different clubs or different balls, is then determined based on differences between transfer efficiencies calculated for different impacts using different captured images resulting from those different impacts.

BRIEF DESCRIPTION OF THE DRAWINGS

FIG. 1*b* schematically shows preferred electrical connections for the system of FIG. 1*a*.

DETAILED DESCRIPTION OF THE PREFERRED EMBODIMENT

Figure 1A:
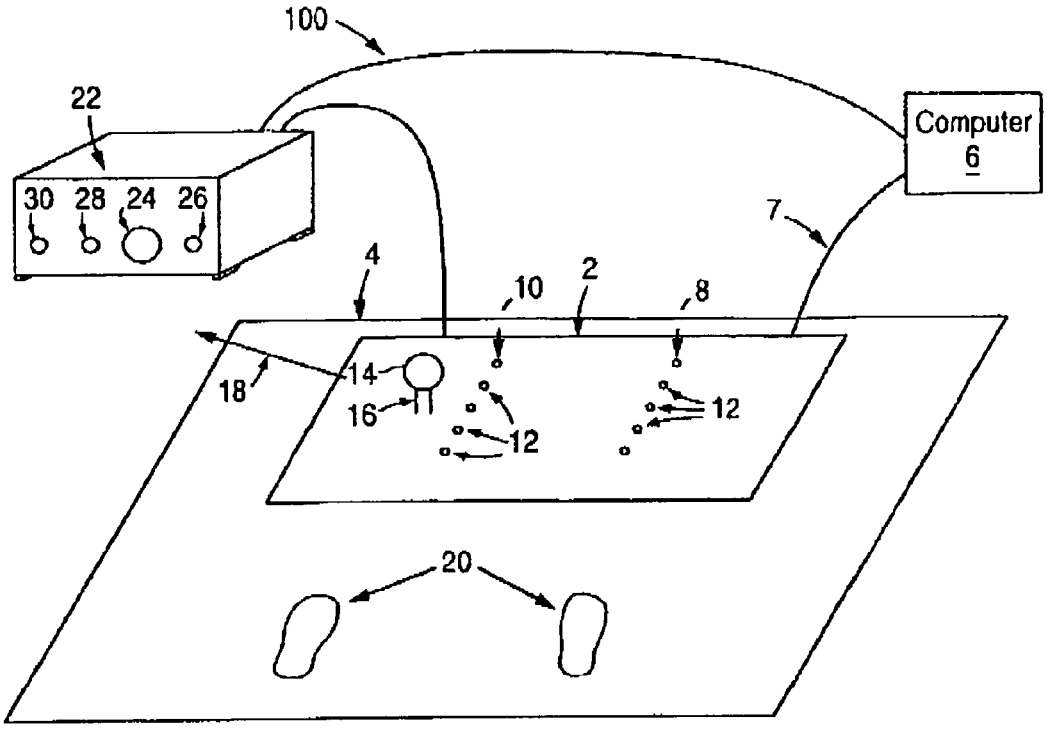
FIG. 1*a* schematically shows a perspective view of a ball flight monitoring system including an impact zone analyzer arranged on a hitting mat.

FIG. 1*a* schematically shows a perspective view of a ball flight monitoring system including an impact zone analyzer 2 arranged on a hitting mat 4. The impact zone analyzer 2 is imbedded within the hitting mat 4 such that the surface of the analyzer 2 is substantially coplanar with that of the hitting mat 4. The analyzer 2 is connected with a computer processor 6 such that data signals may be sent to the computer 6 from the analyzer 2. Although a direct connection 7 is shown between the analyzer 2 and the computer 6, the analyzer 2 may be indirectly connected to the computer 6 through ball flight capture device or system 22, described below.

The analyzer has a first row 8 and a second row 10 of sensors 12 located behind a golf ball 14 on a tee 16. Preferably, each row 8, 10 has around twelve sensors 12. The sensors 12 are preferably photosensors such as light sensitive diodes or CCDs. The golf ball 14, of course, does not have to be located on the tee 16. The analyzer 2 is preferably conventionally connected to the computer 6 such that data representing the amount of light that each sensor 12 receives throughout the duration of a test golf swing may be received by the computer 6 from electronic circuitry (not shown). The circuitry may be internal to the analyzer 2 or external to the analyzer 2 such as within the ball flight capture device 22 that is connected to the analyzer 2, or otherwise.

Although not shown, preferably an overhead lighting arrangement illuminates the hitting mat and especially the first and second rows 8 and 10 of sensors 12. A directional arrow 18 and footprints 20 are merely shown in FIG. 1*a* to give the reader perspective as to where a golfer would be standing during a test swing and what direction the golf ball would generally be heading after impact with a golf club head of a golf club being swung by the golfer.

The ball flight capture device 22 is located in front of the ball 14 on the tee 16 across from where the ball 14 will be located in the air a short time after impact with the golf club head. The device 22 includes a camera 24 and one or more flash lamps, and preferably three flash lamps shown in FIG. 1*a* as a first flash lamp 26, a second flash lamp 28, and a third flash lamp 30. The device 22 is connected to the computer 6 and preferably to the analyzer 2, as shown. Each of the device 22 and the analyzer 2 may be connected to the computer either directly or through other connections such as from the ball capture device 22 through the analyzer 2 to the computer 6, or vice-versa.

The camera 24 of the ball capture device is equipped with a high speed shutter. The shutter opens in response to a trigger signal and closes after a predetermined time. The trigger signal is preferably sent in response to one or more sensors 12 of the first and/or second rows 8, 10 described above.

The flashlamps 26, 28 and 30 are also timed each to flash when the shutter is open and the ball is within the viewing range of the camera 24. The timing of the flashing of the flashlamps 26, 28 and 30 is also preferably determined from the time of receipt of the trigger. The timing of the flashing of flashlamp 26 occurs just before that of flashlamp 28 which is also just before the flashing of flashlamp 30. In this way, three images of the golf ball may be captured by the camera, wherein the time between each flashing is known and can be used to determine ball flight characteristics described in more detail below.

Advantageously, the club head speed is determined either in a calibration swing or during the instant swing. The club head speed is used to determine when the impact with the golf ball will occur and when the golf ball will be within the viewing range of the camera 24. In this way, the flashing of the flashlamps 26, 28, 30 may be timed precisely such that the three images may be reliably captured within the viewing range of the camera 24. The flashlamps 26, 28 and 30 and the camera 24 shown in FIG. 1*a*, which are also included in the embodiment of FIG. 1*d*, are discussed in further detail below particularly with respect to FIGS. 3*a* and 3*b*.

FIG. 1*b* schematically shows preferred electrical connections associated with the ball flight monitoring system 100 of the present invention. The ball capture device 22 has a cable connection labeled "CPA cable" 32 which extends to the analyzer 2 on the hitting mat 4. Three cable connections to the computer 6 from the ball flight capture device 22 are labeled "cable 1" 36, "cable 2" 38 and "cable 3" 34. The computer 6 runs a software program specifically designed for processing input data from cables 34, 36 and 38, and may be otherwise a conventional personal computer 6 including typical peripheral components as shown.

Figure 1C:
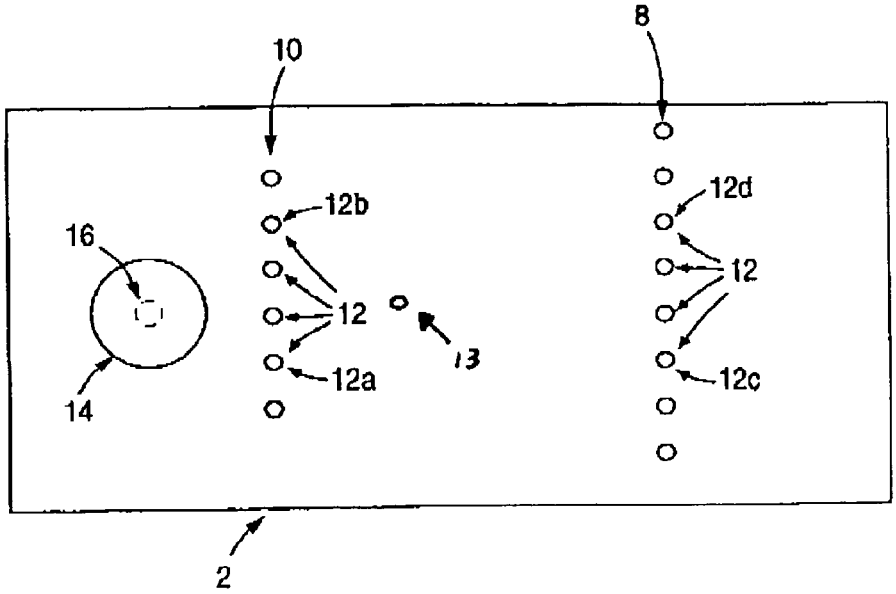
FIG. 1*c* schematically shows an overhead view of the impact zone analyzer of FIG. 1*a*.
Figure 2B:
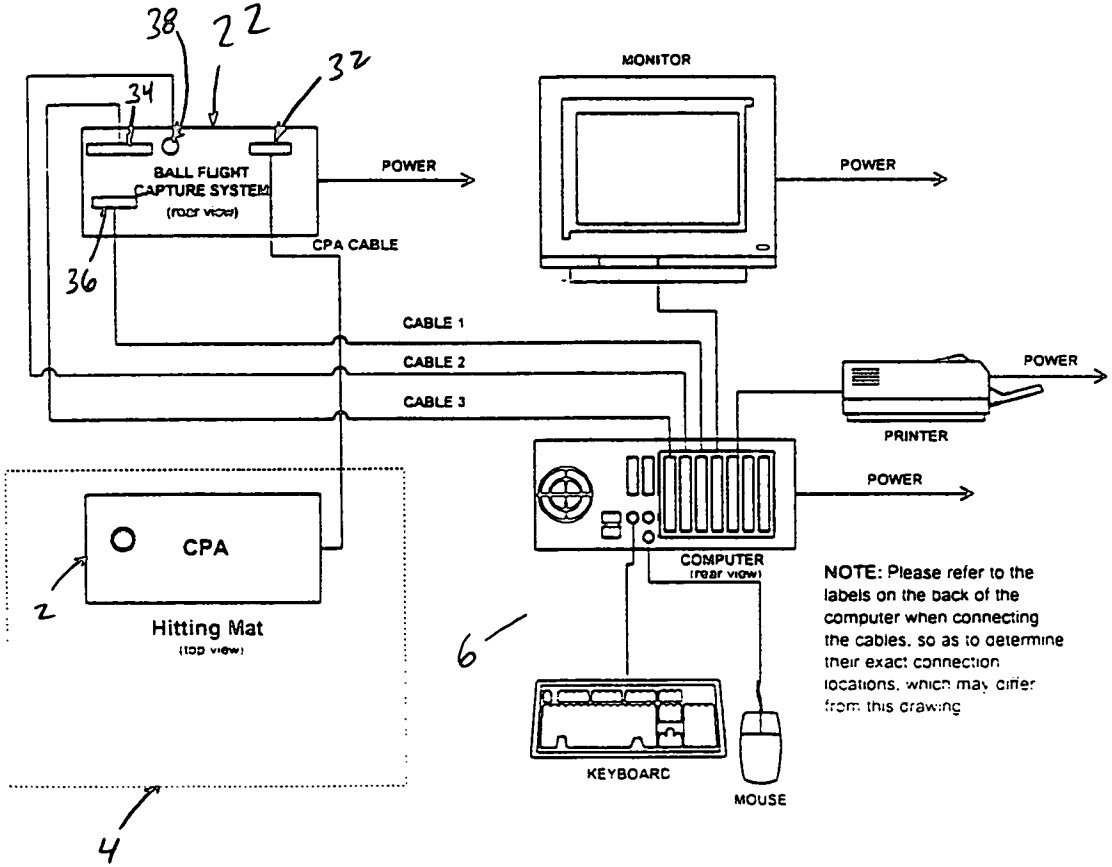
FIG. 2 shows a display view illustrating golf club take away and downswing paths and club head angle determined based on data obtained from sensors of the impact zone analyzer of FIG. 1.
Figure 1D:
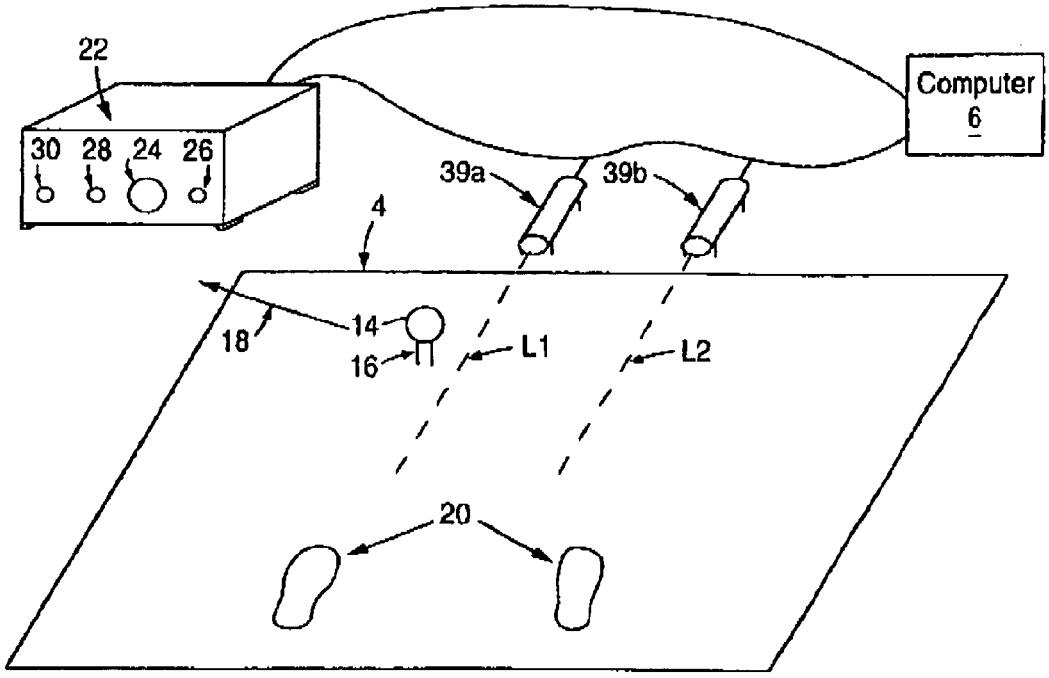
FIG. 1*d* schematically shows an alternative ball flight monitoring system from that shown in FIG. 1*a*.

FIG. 1*c* schematically shows an overhead view of the impact zone analyzer 2 including the ball 14 on a tee 16 prior to impact with a golf club head from the right and a first row 8 and a second row 10 of sensors are also visible in FIG. 1*c*. Each of the sensors 12, the circuitry of the analyzer 2 and the software running on the computer 6 (FIGS. 1*a*–1*b*) are preferably configured for distinguishing between when a golf club head is over the sensor 12 and when the golf club head is not over the sensor 12. This is done by detecting when the overhead light is shining on the sensors 12 and when a shadow is over the sensors 12 due to the presence of the club head. That is, when the golf club head is not over a particular sensor 12, then light from the overhead source is shining directly onto the sensor 12 yielding, e.g., a positive detection of the light by the particular sensor 12. When the golf club head is over a particular sensor 12, then light from the overhead source is blocked from directly shining onto the sensor 12 yielding, e.g., a negative detection of light from the overhead source by the particular sensor 12, or the detection (by not detecting the direct light) of the shadow.

The swing path of the golf club and the angle of the club head just before impact can be monitored using the first and second rows 8, 10 of sensors 12. That is, based on the temporal order and/or duration or degree of blocking of the individual sensors 12 during a test golf swing, the take away and downswing paths and the club head angle can be monitored and displayed for evaluation. The take away swing path is, of course, the path the club head moves along in the backswing of the golfer performing the swing. The downswing path is the path of the club head during the downswing as the club moves toward the position of impact with the ball. The head angle is the angle the club head makes in the toe to heel direction with a line drawn directly back from the ball and parallel to a straightaway flight path.

For example, if the center portion of the club head is sensed as going over the sensor 12*c* and then the sensor 12*a*, the swing is monitored as being somewhat inside out and the impact with the ball maybe somewhat off the toe of the golf club head, whereas if the center portion of the club head is sensed as going over the sensor 12*d* followed by sensor 12*b*, then the impact would be monitored as being somewhat off the heel of the club. Advantageously, the particular swing path can be determined as well, and not just the general features described in the general terms used in the above examples.

The club head angle may be monitored and determined in more than one way. A first way uses only the sensors 12 of the row 10. For example, if the sensor 12*a* were blocked before the sensor 12*b* of the second row 10 during the downswing, then the club head angle would be detected as being somewhat open at the second row 10 of sensors 12, whereas if the sensor 12*b* were detected as being blocked before the sensor 12*a*, then the club head angle would be detected as being somewhat closed at the second row 10. A second way uses the sensor 13 which is located somewhat behind the row of sensors 10 in addition to using sensors 12 of the row 10. Preferably, the sensor 13 is located behind the position of the ball at least approximately on a straight line with a straight away direction of ball flight. Also preferably, the sensor 13 is used along with sensors 12*c* and 12*d* which form a triangle with sensor 13 for determining the club head angle. Advantageously, the particular head angle can be determined in either of these ways, and not just the general features described in the general terms used in the above examples.

FIG. 1*d* illustrates an alternative ball flight monitoring system to the system including the analyzer 2 illustrated at FIG. 1*a*. The alternative system does not include the analyzer 2 of the system of FIG. 1*a*, but does include the computer 6 and the ball flight capture device 22 described above. Preferably two club sensing devices 39*a* and 39*b* for determining club head speed and for triggering or initiating a process leading to the triggering of the camera 24 and/or the flash lamps 26, 28 and 30 is provided in this alternative embodiment.

The sensors 39*a* and 39*b* are configured to detect when the club head crosses in front of them, such as by crossing the imaginary lines L1 and L2 shown in FIG. 1*d* for illustrative purposes. The sensors 39*a* and 39*b* are preferably photosensitive, and may be motion sensitive or otherwise, for detecting the precise time when the club crosses the imaginary lines L1 and L2. At least one of the sensors 39*a* or 39*b* is preferably used for triggering the camera 24 and lamps 26, 28 and 30. The system uses input from sensors 39*a* and 39*b* in determining the club head speed by analyzing the time difference between when the imaginary lines L1 and L2 are crossed by the club head. The club speed is in turn used to estimate the time until the ball will pass into the image field of the camera 24. Using this estimated time, the system will calculate when to shutter the camera 24 and to flash the lamps 26, 28 and 30 to capture images of the ball with the camera. Alternatively, a default of average timing is used from the receipt of the trigger signal by the computer 6 and/or ball flight capture device 22 for shuttering and flashing.

In the preferred method of use, the club speed may be determined during a calibration swing and that same determined value used for subsequent swings. Alternatively, a new club speed may be determined for each swing. In a third alternative method, an average or default club speed may be used for all test swings. When this method is used, the default club speed is used to estimate the time delay between detection of the club by sensors. Since no real time speed measurement is taken using this method, only one of the sensors 39*a*, 39*b* may be used. The head angle and take away and downswing paths that are advantageously determined in the way described above in accord with the system of FIG. 1*a* are not so determined in this alternative embodiment.

The alternative system illustrated at FIG. 1*d* may be advantageously used for golf swing evaluations at any arbitrary hitting position, such as at a typical driving range hitting mat or a grassy or sandy area. Thus, a golf ball 14 sitting on a real grassy or sandy lie, or on a tee 16, may be impacted by a golf club and the resulting ball flight evaluated using the system shown at FIG. 1*d*. In addition, the system of FIG. 1*d* is advantageously portable for moving around a practice area or golf course.

Figure 2:
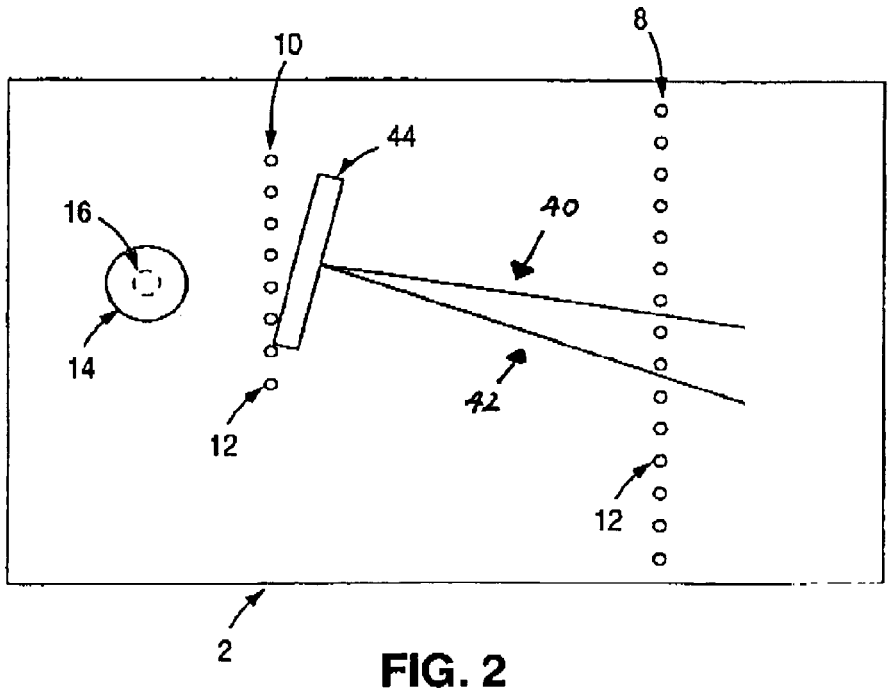

FIG. 2 shows a display view illustrating a golf club take away path 40, a downswing path 42 and a club head angle 44 determined based on data obtained from the first and second rows 8, 10 of sensors 12 of a preferred impact zone analyzer 2 overlayed in the display, in accord with using the system shown at FIG. 1*a* in accord with the present invention. The take away path 40 and downswing path 42 are preferably the paths of the center of gravity of the club head as it goes back during the take away portion, and comes through during the downswing portion, respectively, of a test swing. The paths 40, 42 could also be the paths 40, 42 of another point on the club head other than the center of gravity such as a point nearer the heel or toe of the club head. The paths 40, 42 are determined based on which ones and in what order and/or for what duration the individual sensors 12 of the first and second rows 8 and 10 were blocked during the take away and downswing portions of the test swing.

The head angle 44 illustrated in the display is that of the club head at the second row 10 nearest the impact point with the ball 14. The distance between the second row 10 and the ball 14 may be closer than is represented by any of FIGS. 1*a*–1*c* or 2, such that the head angle 44 at the second row 10 very nearly represents the ultimately important head angle 44 at impact. On that point, none of the distances in the figures of this application are necessarily drawn to scale.

The software may estimate the head angle at impact from the head angle at the second row and/or at the first row, and may use another estimate for the rate of closing of the head from the second row to the impact point to make the estimation. For example, although the head appears to be slightly open at the second row 10 in FIG. 2, the head 44 is likely somewhat less open at impact, depending on the skill level of the golfer performing the test swing. In practice, the second row 10 of sensors 12 is so close to the impact position that the head angle at the second row 10 of sensors 12 is at least almost exactly the head angle at impact.

Figure 3A:
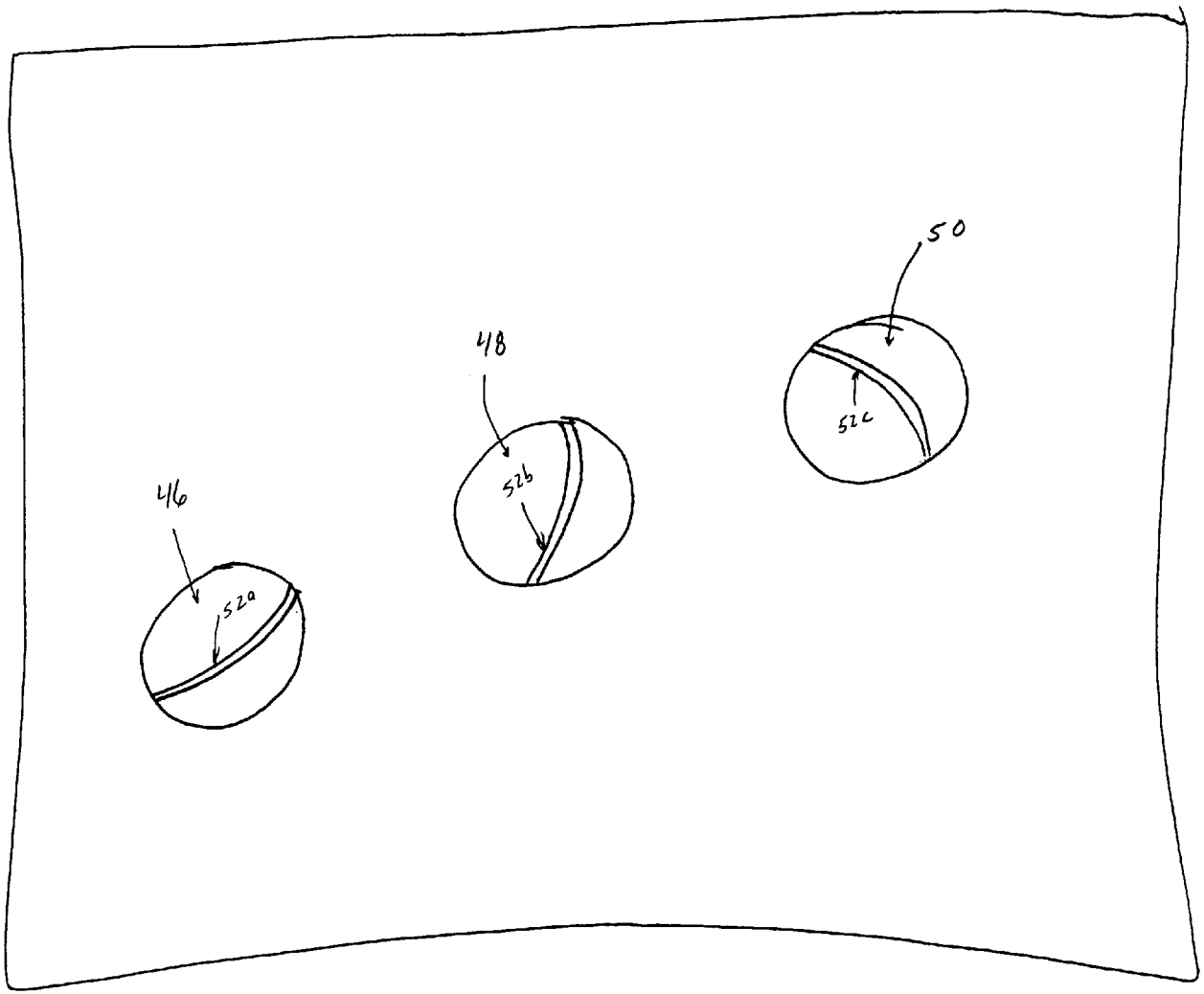
FIG. 3*a* shows a display view of multiple temporally successive images of a golf ball having a marking utilizing principles of the present invention.

FIG. 3*a* shows a display view of three temporally successive images 46, 48 and 50 of a golf ball 14 during flight after impact with a golf club head, wherein each golf ball image 46, 48 and 50 shows an image on the golf ball 14 of a marking 52*a*, 52*b* and 52*c*, respectively. In accord with the present invention. Although three images 46, 48 and 50 are shown, two or more than three images may be captured and used for determining initial flight conditions of the ball 14. Each image is captured by the camera 24 of FIG. 1*a* when its shutter is open and light from one of the flashlamps 26, 28 and 30 reflects from the ball through the shutter of the camera 24 and onto an image capture detector. The captured images are sent to the processor 6 for display and/or analysis and evaluation.

The computer 6 determines kinematic properties of the ball in flight based on these images by photogrammetry. As mentioned above, the image capture timing is preferably determined based on the club head speed determined by the analyzer 2, preferably from a calibration swing.

A calibration routine is preferably performed prior to capturing the images. The processor uses information obtained during the calibration routine to determine the position of the center of gravity of the ball and the velocity of the ball, as well as preferably other dynamic or kinematic characteristics such as sidespin and backspin on the ball, from the captured images.

The calibration routine preferably includes positioning a calibration fixture (not shown) in the viewing range of the camera 24 and capturing an image of the fixture. The fixture preferably has several illuminable images appearing similar to a golf ball in flight. The '383 application uses a calibration fixture for calibration as well (see FIG. 3), but in contrast to the preferred fixture used herein, each illuminable image in the fixture described in the '383 application includes multiple spots similar to those used for determining dynamic characteristics of the golf ball in flight according to further description contained in the '383 application.

Alternatively, parameters such as the distance and direction of the camera from the center of its viewing range, the actual size of the golf ball, the apparent size of the golf ball at certain distances from the camera, the position of the camera from the impact position of the club head with the ball, etc., are input to the processor from its software or an input device such as a keyboard. The dynamic parameters mentioned above may then be determined using the processor based on features of the captured images of the ball in flight and the parameters determined and/or received by the processor during the calibration routine.

The actual marking on the ball 14 is preferably, but not necessarily, circumferentially drawn around the entire ball 14 such as to separate the ball 14 into two hemispheres like a meridian and to form a closed loop. The marking is more specifically preferably at least halfway circumambulatory of the ball 14, but need not be closed around the entire ball 14. The marking is preferably long enough that it may be within the camera view no matter what the rotational position of the ball is when its image is captured.

More than one marking may be provided. The two or more markings may be off center such that for each marking the two areas separated by the marking are not equal. The degree of equality or inequality of the two areas is however known in each case and programmed into the software running on the computer 6 of the ball flight monitor system of the present invention.

The three images of FIG. 3*a* are exemplary of those captured by the camera 24 of the ball capture device 22 discussed above, each due to the flashing of one of the lamps 26, 28 and 30. By comparing and contrasting two of or preferably all three of the images 46, 48 and 50 using the software running on the computer 6 and the known timing between the capturing of the images, initial ball flight characteristics such as horizontal and vertical velocity, including speed and direction, and total spin, including backspin and sidespin, can be determined. Analysis and computation by the processor running the particular software routines programmed into it in accord with the present invention can then reveal the total ball flight characteristics such as total distance and flight trajectory.

Figure 3B:
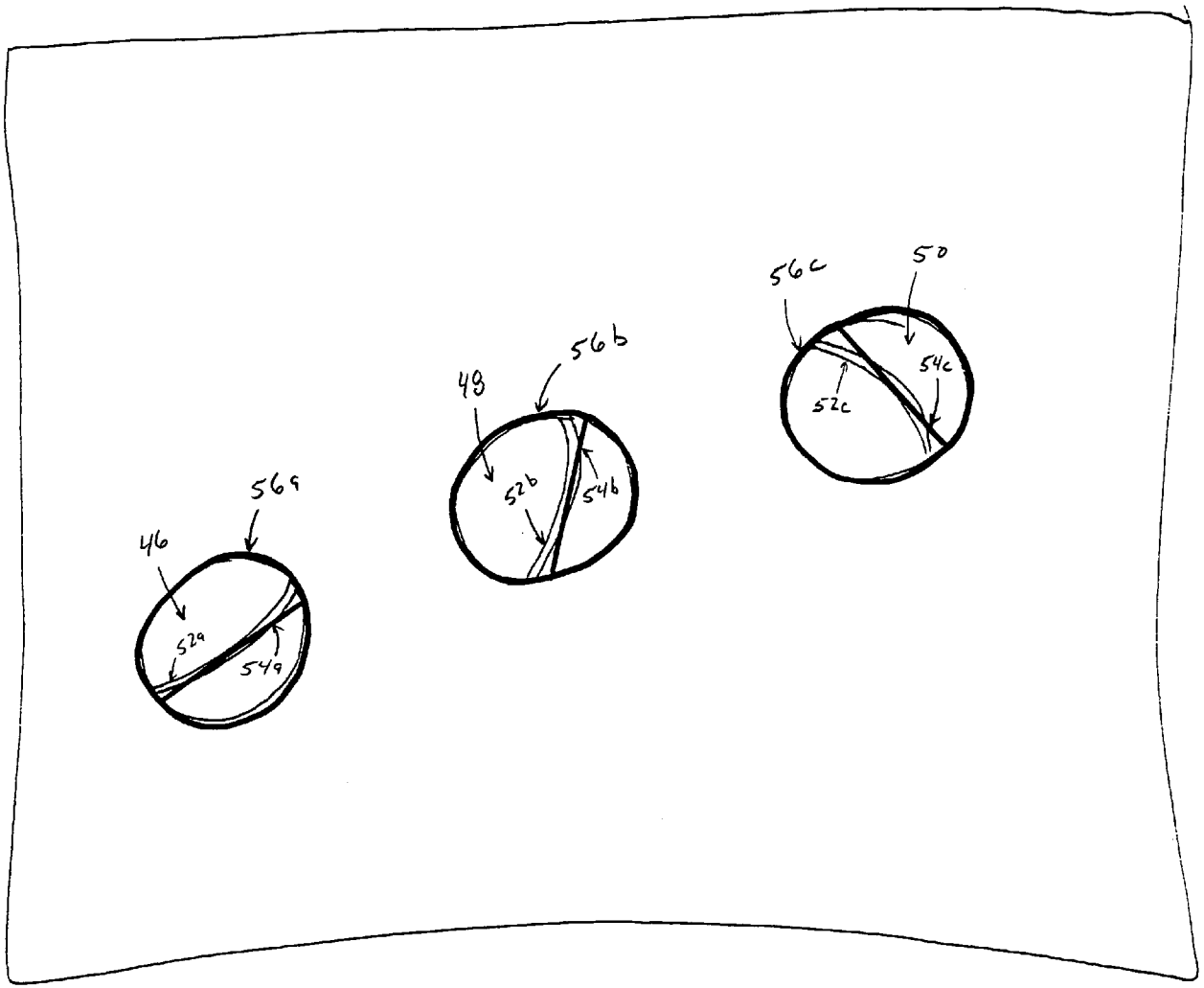
FIG. 3*b* shows a display view of multiple temporally successive images of the golf ball having the marking of FIG. 3*a*, and software generated linear and circumferential extrapolations based on the images.

FIG. 3*b* shows a display view of the multiple temporally successive images 46, 48 and 50 of the golf ball 16 including the marking images 52*a*, 52*b* and 52*c* as shown and described with respect to FIG. 3*a*. In addition, FIG. 3*b* shows software generated linear extrapolations 54*a*, 54*b* and 54*c* of the marking images 52*a*, 52*b* and 52*c*, respectively. Also, FIG. 3*b* shows circumferential extrapolations 56*a*, 56*b* and 56*c* based on the two-dimensional captured perimeters of the images 46, 48 and 50, respectively, in accord with the present invention. A calibration routine is preferably used that allows the computer to recognize the general shape and size within predetermined ranges of the images 46, 48, 50 of the ball 14 after the images 46, 48, 50 are captured.

The linear extrapolations 54*a*, 54*b* and 54*c* of the marking images 52*a*, 52*b* and 52*c* are performed by the computer 6 from the curved marking images 52*a*, 52*b* and 52*c* illustrated at FIGS. 3*a*–3*b*. This curvature is caused at least in part by sidespin on the ball 14 and/or the location of the ball 16 at the times each image was captured relative to the camera exposure aperture in the vertical plane of the field of view shown at FIG. 3*b*, and the fact that the surface of the actual ball 14 is curved. The software takes into account each of these factors in making the linear extrapolations 54*a*, 54*b* and 54*c*.

Once the linear extrapolations 54*a*–54*c* are calculated, then the initial backspin on the ball is calculated by first comparing and contrasting the linear extrapolations 54*a*–54*c*. Qualitatively speaking, the initial backspin may be determined in accord with the present invention based on angular differences between the linear extrapolations 54*a*–54*c* and known time differences between the capturing of the images 46, 48 and 50. The computer 6 advantageously automatically performs this backspin determination based on a comparison of the linear extrapolations.

The circumferential extrapolations 56*a*–56*c* allow the computer to determine the geometric center of the ball, which is assumed to be the center of gravity of the ball 14 as well. This determination is performed as a calculation by the processor using parameters set in the calibration routine, such as relative positions of the camera 24 with respect to where the ball 14 will be in the air when the images are captured, the known timing between the flashing of the flashlamps and thus the capturing of the images, and using the circumferential extrapolations and relative positions of the captured images.

The circumferential extrapolations are preferably used to determine the diameter or radius of each image 46, 48, 50. Although the actual diameter of the ball 14 does not change, at least after the ball 14 resumes its spherical shape after being deformed at impact, each image diameter depends on how near to the camera that the ball is when each image 46, 48, 50 is captured. For example, a larger image diameter means the ball 14 was closer to the camera when the image 46, 48 or 50 was captured. By analyzing one or more, preferably at least two or all three, of these image diameters, the computer 6 can advantageously calculate the relative positions in three spatial dimensions of the geometric center of the ball 14 at each image location, and the three-dimensional velocity including speed and direction that the geometric center of the ball 14 is initially heading in using the known timing between the capturing of the images, including a component of each of the relative position and velocity into or out of the plane of the camera view.

The curvatures of the actual markings 52*a*–52*c* is also used advantageously to determine the sidespin on the ball 14. The rotated positions of the markings 52*a*–52*c* as well as the curvatures at those positions allows the computer 6 to precisely determine the sidespin. Advantageously, based on the sidespin so determined, the trajectory of the ball flight, especially as the ball curves from left to right, may be determined with precision. Thus, the combination of the determinations made by the computer 6 based on the images 46, 48, 50, including the extrapolations 54*a*–54*c* and 56*a*–56*c*, and the position and curvature determination of the marking images, allows the computer to factor the initial backspin and sidespin and initial vertical and horizontal velocities of the ball 14 into the calculation of the total ball flight characteristics.

Another feature may be added to the any of the above embodiments. That is, an additional image may be captured by the system. The additional image is captured at the impact timing of the club head with the ball. The additional image would include an image of the ball as well as the club head, and particularly the relationship between the position of the ball with the club head at the impact time.

The additional image may be one captured with the use of an additional flashlamp, or one of the flashlamps described above for use with one of the images captured during the ball flight may be used to capture the impact image. In the latter case, one fewer images will be captured of the ball 14 during flight. For the embodiments described above using three images, the images of the ball 14 in flight would then be two, and one skilled in the art would realize that two is enough to determine initial ball flight conditions.

The ball flight capture device 22 may be modified to capture this additional image at the time of impact. The modification may be simply to move the camera 24 so that the impact position is within the viewing range of the camera 24. The viewing range may also be widened to include the impact position. The impact timing is estimated preferably using a club head speed calculated in a calibration swing or also may be calculated during the swing at issue or using a default club head speed. After the club head passes one or both of the rows 8, 10 or one or both of the sensors 39*a*, 39*b*, the time until impact being known based on the club head speed and distance remaining until impact, the first flash is produced by one of the flashlamps 26, 28 or 30, preferably flashlamp 26, at the time of the impact and the image captured.

Advantageously, the position of the club head with respect to the ball and/or the surface of the ground at impact are captured for analysis. It may be observed from the captured image at impact whether the club head is "toe up", "toe down" or even at impact. Toe up, of course, means that the bottom surface of the club head is angled towards the ground beneath from the heel to the toe. That is, the toe is nearer the ground surface than the heel at impact, a factor that can result in an errant ball flight path. Toe down is the opposite of toe up. A golfer preferably wants the club head to be even at impact, and neither toe up or toe down. Using the impact image in accord with the present invention can allow the golfer to fix this type of defect in his or her swing.

It may also be observed whether the ball is struck at the center or nearer the toe or heel of the club head at impact. In addition, the club head angle will be apparent in the impact image, such that it may be observed how open or closed the face of the club is at impact, and it may also be observed what the loft of the club is at impact. It may also be observed whether the ball was impacted "thin" or "fat" from the captured image of the impact. A thin hit is one where the club head is higher on the ball at impact than it should be, and a fat hit is one where the club head is lower on the ball at impact. A fat hit usually follows impact with the ground behind the ball.

Figure 4A:
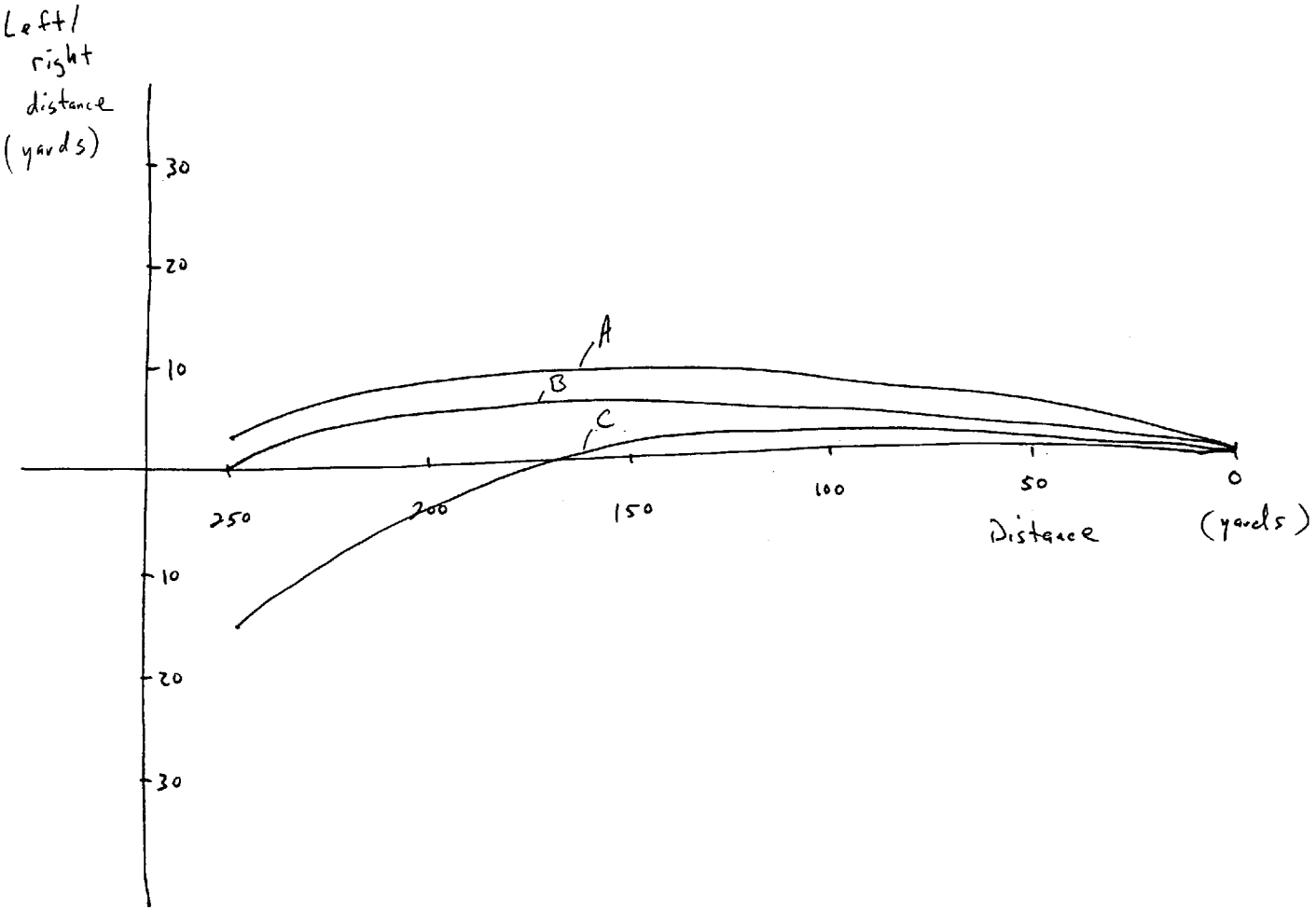
FIG. 4*a* shows an overhead view representing total golf ball flight characteristics calculated based on the images and extrapolations shown in FIG. 3*b*.

FIG. 4*a* shows an overhead view representing total golf ball flight characteristics calculated based on the images and extrapolations shown and described above, particularly with respect to FIG. 3*b*. Three horizontal flight trajectories are shown in FIG. 4*a* that were calculated from three different test swings. The horizontal axis is the "distance" in yards and the vertical axis is the left to right distance.

As can be observed, the ball started out moving in a direction right of straightaway along flight path A, but then "drew", or moved right to left due to counterclockwise spin (using the perspective of FIG. 4*a*) imparted to the ball at impact. The swing that was calculated by the computer 6 based on initial flight conditions to produce flight path A, and determined in accord with the present invention, caused the ball to land about 250 yards out and only about 5 yards right of straight away. The ball traveling along flight path B started out a little less right of straight away than that for flight path A, had a similar draw, and landed about 5 yards to the left of the flight path A ball. The ball traveling along flight path C started even less right of straight away than that for flight path B, and a little more draw such that the ball was calculated to land about 15 yards left of straight away, again about 250 yards down the fairway.

Figure 4B:
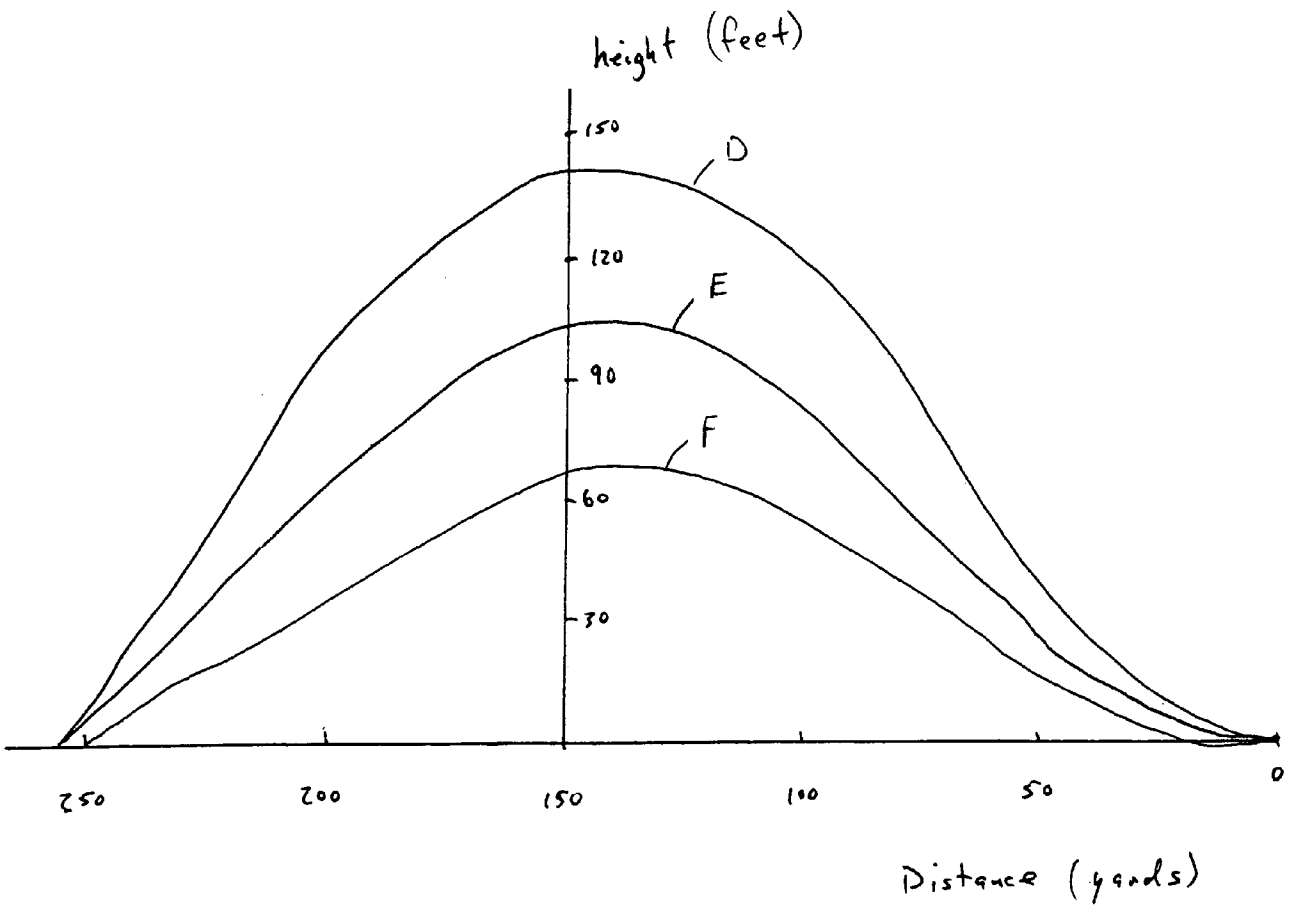
FIG. 4*b* shows a side view representing total golf ball flight characteristics calculated based on the images and extrapolations shown in FIG. 3*b*.

FIG. 4*b* shows a side view representing total golf ball flight characteristics calculated based on the images and extrapolations described above, particularly with respect to FIG. 3*b*. The horizontal axis again shows the distance down the fairway that the ball was calculated to travel in the air. This time, the vertical axis shows the height of the golf ball as it traveled along its flight path. Again, three paths D–F are shown in FIG. 4*b*.

The golf swing that was calculated by the computer 6 to cause the ball to travel along flight path D was shown to rise to about 140 feet before beginning its downward ascent to land about 250 yards down the fairway. The flight paths E and F has a maximum calculated altitude for the respective balls to be 100 and 70 yards, respectively, while each ball was calculated to land around 250 yards down the fairway.

It is emphasized that the flight paths shown and described with respect to FIGS. 4*a* and 4*b* are only examples to show the kinds of calculations and displays that the present invention can do. Again, the total initial spin including backspin and side spin and the total initial velocity including components in three dimensions are advantageously determined and used to calculate the flight paths of FIGS. 4*a* and 4*b*. The aerodynamic lift caused by spin and aerodynamic drag may be used as inputs to figure the total flight characteristics of the ball. Other factors may be inputs for the computer to use in the calculations such as wind, air density or altitude, various club and ball parameters such as club speed and loft, ball cover hardness or durometer reading, ball core spin density, relative impact positions of the club head with the ball, weather conditions such as rain, etc. As noted, the relative impact positions and club speed can be determined in accord with the present invention.

Another parameter that may be advantageously calculated in accord with the present invention is the energy transfer efficiency of the impact of the club head with the ball. That is, the club head speed and initial velocity and spin of the ball may be determined in accord with the present invention. Thus, the efficiency can be calculated by subtracting the energy that a ball would have if a perfectly elastic collision occurred between the club head and ball, and the actual energy that the ball is observed to have in the form of translational and rotational kinetic energy minus work done against gravity to reach the image position or positions used in the calculation. This efficiency determination can be advantageously used in consideration of the quality of the equipment, i.e., the ball and club, that are used during the test swing.

Those skilled in the art will appreciate that the just-disclosed preferred embodiments are subject to numerous adaptations and modifications without departing from the scope and spirit of the invention. Therefore, it is to be understood that, within the scope and spirit of the invention, the invention may be practiced other than as specifically described above. The scope of the invention is thus not limited by the particular embodiments described above. Instead, the scope of the present invention is understood to be encompassed by the language of the claims that follow, and structural and functional equivalents thereof.

What is claimed is:

1. An apparatus for monitoring a swing path and/or a golf club head angle at or near an impact location with a golf ball during a golf swing, comprising:

a golf ball impact location for receiving a golf ball;

a first array of sensors proximate to the impact location;

a second array of sensors spaced apart from the first array behind the impact position along a swing path, the first and second array positioned such that a golf club swung in preparation for contact with a golf ball at the impact location will have a swing plane in angular relation to the first and second arrays;

an image capture device consisting essentially of a single camera for capturing two or more two-dimensional images of the golf ball after impact with the golf club head and outputting visual image data generated exclusively from the two-dimensional images captured by the single camera; and a processor for receiving signals indicative of a temporal profile of which sensors the golf club head is over during the swing and for determining at least one of a swing path and a club head angle of the golf club based on said signals indicative of the temporal profile, the processor further for determining three-dimensional velocity of the golf ball by extrapolating perimeters of the image of the golf ball utilizing data wherein the only visual image data utilized is visual image data generated exclusively from the two-dimensional images captured by the single camera in two or more images taken using the single camera, and by determining three-dimensional spatial positions of the ball utilizing data wherein the only visual image data utilized is the visual image data generated exclusively from the two-dimensional images captured by the single camera and calculating the three-dimensional velocity of said golf ball based on said three-dimensional spatial positions.

2. The apparatus of claim 1, wherein said first and second arrays include a plurality of sensors arranged substantially linearly and orthogonal to said swing plane.

3. The apparatus of any of claims 1 or 2, wherein the processor is further for using the signals indicative of the temporal profile to determine a swing path of the club head between the first and second arrays during the swing.

4. The apparatus of claim 3, wherein the processor is further for determining a take away swing path of the club head from the first array to the second array during the swing and a downswing path of the club head from the second array to the first array towards the impact location during the swing.

5. The apparatus of any one of claims 1 or 2, wherein the processor is further for using the received signals to determine the angle of the golf club head during movement of the club head across the first array toward the impact location.

6. The apparatus of claim 5, wherein the first array includes a back sensor that is positioned just behind the substantially linearly arranged sensors in the first array along a swing path of the golf club, for determining the club head angle.

7. An apparatus for monitoring a golf club head angle at or near an impact location of the club head with a golf ball during a golf swing, comprising:

an array of sensors arranged at an angle to a plane of a golf swing of a golf club head;

an image capture device consisting essentially of a single camera for capturing two or more two-dimensional images of a golf ball after impact with the golf club head and outputting visual image data generated exclusively from the two-dimensional images captured by the single camera; and a processor for receiving signals indicative of a temporal profile of which sensors the golf club head is over during the swing and for determining a club head angle of the golf club based on the signals indicative of the temporal profile, the processor further for determining three-dimensional displacement of the golf ball by extrapolating perimeters of the image of the golf ball utilizing data wherein the only visual image data utilized is visual image data generated exclusively from the two-dimensional images captured by the single camera in two of more images taken using the single camera, by determining three-dimensional spatial positions of the ball utilizing data wherein the only visual image data utilized is the visual image data generated exclusively from the two-dimensional images captured by the single camera and calculating the three-dimensional displacement of said golf ball based on said three-dimensional spatial positions.

8. The apparatus of claim 7, wherein said array includes a plurality of sensors arranged substantially linearly and orthogonal to a swing path of the golf club head.

9. The apparatus of claim 8, wherein said array further includes a back sensor behind said plurality of substantially linearly arranged sensors.

10. The apparatus of any one of claims 7–9, wherein the processor is for determining the club head angle and swing path.

11. The apparatus of claim 1 or 7, wherein said golf ball includes a marking that is at least partially in view of the camera for any rotational position of the golf ball.

12. The apparatus of claim 11, wherein said marking is substantially a stripe at least halfway circumambulatory of the surface of the golf ball.

13. The apparatus of claim 11, wherein said marking is a closed loop around the surface of the golf ball.

14. The apparatus of claim 13, wherein said marking separates substantially equal hemispheres of the golf ball.

15. The apparatus of claim 12, wherein said marking separates substantially equal hemispheres of the golf ball.

16. The apparatus of claim 12, wherein said processor automatically finds said marking on at least two images of the golf ball and calculates a linear extrapolation of said marking for each of said images of the golf ball.

17. The apparatus of claim 16, wherein said processor calculates backspin on said ball based on a comparison of said linear extrapolation from at least two of said images.

18. The apparatus of claim 17, wherein said processor calculates sidespin on said ball based at least in part on curvatures of said marking in the images of the golf ball on at least two of said images.

19. The apparatus of claim 7, wherein said processor automatically finds a perimeter of each of said images of the golf ball and calculates a circumferential extrapolation of each of said images of the golf ball.

20. The apparatus of claim 19, wherein said processor determines diameters of said two or more images of the golf ball based on said circumferential extrapolations of said two or more images of the golf ball and calculates a three-dimensional velocity of said ball based in part on a comparison of said diameters.

21. The apparatus of claim 19, wherein said processor calculates a diameter based on said circumferential extrapolation and calculates a three-dimensional velocity of said ball based in part on said diameter.

22. The apparatus of claim 12, wherein said processor automatically finds a perimeter of the image of the golf ball in said at least two images and calculates a circumferential extrapolation of the image of the golf ball in said images.

23. The apparatus of claim 22, wherein said processor determines diameters of the image of the golf ball in said two or more images based on said circumferential extrapolations of the image of the golf ball from said two or more images and calculates a three-dimensional velocity of said ball based in part on a comparison of said diameters.

24. The apparatus of claim 22, wherein said processor calculates a diameter of the image of the golf ball based on said circumferential extrapolation and calculates a three dimensional velocity of said ball based in part on said diameter.

25. The apparatus of claim 12, wherein said processor calculates sidespin on said ball based in part on curvatures of said marking on said images.

26. The apparatus of claim 25, wherein said processor calculates a circumferential extrapolation of the image of the golf ball in two or more of said images.

27. The apparatus of claim 26, wherein said processor calculates three-dimensions of velocity based in part on a comparison of diameters of the image of the golf ball in two or more of said circumferential extrapolations.

28. The apparatus of claim 27, wherein said processor calculates sidespin based in part on curvatures of said marking on said images.

29. The apparatus of claim 27, wherein said processor is further for determining three dimensional velocity based upon said three-dimensional spatial positions.

30. An apparatus for determining spin characteristics of a golf ball after impact with a golf club head comprising:

an image capture device consisting essentially of a single camera for capturing two or more two-dimensional images of the golf ball after impact with the golf club head and outputting visual image data generated exclusively from the two-dimensional images captured by the single camera; and a processor connected with said image capture device and configured to receive data wherein the only visual image data received is visual image data generated exclusively from the two-dimensional images captured by the single camera;

wherein said golf ball has at least one marking that is at least halfway circumambulatory of the surface of said golf ball such that said marking is at least partially within the view of said camera for any rotational position of said golf ball when said images are taken; and wherein said processor determines spin of said ball based on an automatic determination of at least one characteristic of only one of said markings on images captured only with said camera;

said at least one characteristic including curvature of said marking.

31. The apparatus of claim 30, further comprising one or more sensors for triggering the capturing of the images by the camera.

32. The apparatus of claim 31, wherein the one or more sensors are one or more photosensors that sense the club head as the club head moves past the one or more sensors during a downswing prior to impact with the ball.

33. The apparatus of any one of claims 30 or 31, wherein said marking is a closed loop around the surface of the golf ball.

34. The apparatus of claim 33, wherein said marking separates substantially equal hemispheres of the golf ball.

35. The apparatus of any one of claims 30 or 31, wherein said marking separates substantially equal hemispheres of the golf ball.

36. The apparatus of any one of claims 30 or 31, wherein said processor automatically finds said marking and calculates a linear extrapolation of said marking for each of said images.

37. The apparatus of claim 36, wherein said processor calculates backspin on said ball based on a comparison of linear extrapolations from at least two of said images.

38. The apparatus of claim 37, wherein said processor calculates sidespin on said ball based at least in part on curvatures of said markings on said images.

39. The apparatus of claim 30, wherein said processor automatically finds a perimeter of the image of the golf ball utilizing data wherein the only visual image data utilized is visual image data generated exclusively from the two-dimensional images captured by the single camera in at least one image and calculates a circumferential extrapolation of said image.

40. The apparatus of claim 39, wherein said processor determines diameters of the image of the golf ball in said two or more images based on circumferential extrapolations from said two or more images and calculates a three-dimensional velocity of said ball based in part on a comparison of said diameters, and wherein said calculation is independent of an orientation of the circumambulatory marking on said images.

41. The apparatus of claim 39, wherein said processor calculates a diameter of the image of the golf ball based on said circumferential extrapolation and calculates a three dimensional velocity of said ball based in part on said diameter.

42. The apparatus of claim 31, wherein said processor automatically finds a perimeter of the image of the golf ball in at least one image and calculates a circumferential extrapolation of said image.

43. The apparatus of claim 42, wherein said processor determines diameters of the image of the golf ball in said two or more images based on circumferential extrapolations from said two or more images and calculates a three-dimensional velocity of said ball based in part on a comparison of said diameters.

44. The apparatus of claim 42, wherein said processor calculates a diameter of the image of the golf ball based on said circumferential extrapolation and calculates a three dimensional velocity of said ball based in part on said diameter.

45. The apparatus of any one of claims 30 or 31, wherein said processor calculates sidespin on said ball based in part on curvatures of said marking on said images.

46. The apparatus of claim 45, wherein said processor calculates a circumferential extrapolation of the image of the golf ball utilizing data wherein the only visual image data utilized is visual image data generated exclusively from the two-dimensional images captured by the single camera in two or more of said images.

47. The apparatus of claim 46, wherein said processor calculates three-dimensions of velocity based in part on a comparison of diameters of circumferential extrapolations from two or more of said images, and wherein said calculation is independent of any determined characteristic of the marking on said images.

48. The apparatus of any one of claims 30 or 31, wherein said spin is a type of spin selected from a group consisting of backspin and sidespin.

49. The apparatus of any one of claims 30 or 31, wherein said spin is backspin.

50. The apparatus of any one of claims 30 or 31, wherein said spin is sidespin.

51. The apparatus of any one of claims 30 or 31, wherein said processor is further for determining three-dimensional velocity of said ball.

52. The apparatus of claim 30, further comprising two sensors, said processor for receiving signals indicative of when the golf club is detected by each of the two sensors and estimating when the golf ball will be within a view of said camera for capturing said one or more images based on the received signals.

53. The apparatus of any one of claims 31–32, wherein said one or more sensors include at least two sensors, wherein said processor receives signals indicative of when the golf club is detected by each of the at least two sensors and estimates when the golf ball will be within a view of said camera for capturing said one or more images based on the received signals.

54. The apparatus of claim 30 wherein said marking is a stripe.

55. The apparatus of claim 30 wherein said at least one characteristic further includes orientation of said marking.

56. An apparatus for determining ball velocity in three dimensions of a golf ball after impact with a golf club head, comprising:

an image capture device consisting essentially of a single camera for capturing two or more two-dimensional images of the golf ball after impact with the golf club head and outputting visual image data generated exclusively from the two-dimensional images captured by the single camera; and a processor connected with said image capture device for calculating a three-dimensional ball velocity by determining circumferential extrapolations of perimeters of the image of the golf ball utilizing data wherein the only visual image data utilized is visual image data generated exclusively from the two-dimensional images captured by the single camera in two or more images obtained only by using the single camera, by automatically determining and comparing three-dimensional spatial positions of the image of the golf ball in said two or more images, and by calculating three-dimensional velocity using said three-dimensional spatial position determination and comparison.

57. The apparatus of claim 56, wherein said three-dimensional spatial positions are determined based in part on a determination of diameters of the image of the golf ball in said images.

58. The apparatus of claim 56 wherein the processor is further for determining a three-dimensional spatial position of the geometric center of at least one image and for calculating the three-dimensional velocity based in part on said three-dimensional spatial position determination.

59. The apparatus of claim 56, wherein said processor is further for determining three-dimensional displacement of said ball.

60. The apparatus of any one of claims 1, 7, 30, 56, or 58, wherein said apparatus also captures an image of said golf ball and said golf club at impact such that a relative orientation of said club with respect to said ball may be evaluated.

61. The apparatus of claim 56, wherein said three-dimensional velocity is also based at least in part on a timing of the ball impact and the capturing of said images.

62. The apparatus of claim 61, wherein said three-dimensional velocity is also based on a three-dimensional spatial position of said ball at said impact location.

63. The apparatus of any one of claims 56 or 58, wherein said golf ball has a marking that is at least halfway circumambulatory of the surface of said golf ball such that said marking is at least partially within the view of said camera for any rotational position of said golf ball when said images are taken.

64. The apparatus of claim 63, wherein sidespin on said golf ball is determined based on curvatures of said marking in said images.

65. The apparatus of claim 63, wherein said processor automatically finds said marking and calculates linear extrapolations of said marking in said images and determines backspin based on a comparison of said linear extrapolations.

66. The apparatus of claim 63, wherein said processor automatically determines a circumferential extrapolation of the image of the golf ball in at least one image, calculates a three-dimensional spatial position from said circumferential extrapolation and determines a three-dimensional velocity based at least in part on said three-dimensional spatial position.

67. The apparatus of claim 66, wherein said processor calculates a diameter of the image of the golf ball in said at least one image from said circumferential extrapolation and calculates a three-dimensional extrapolation based in part on said diameter.

68. The apparatus of claim 63, wherein said marking is substantially a straight line within a plane of the surface of the ball.

69. A system for monitoring spin of a golf ball following impact by a golf club, the system comprising:

a golf ball having an elongated stripe thereon;

an image capture device consisting essentially of a single camera positioned to capture at least two two-dimensional images of the golf ball following impact by a golf club and outputting visual image data generated exclusively from the two-dimensional images captured by the single camera; and a processor for finding the stripe utilizing data wherein the only visual image data utilized is visual image data generated exclusively from the two-dimensional images captured by the single camera in images captured only by the single camera and for determining a spin of the ball based on at least one characteristic of the stripe in said images;

said at least one characteristic including curvature of said stripe.

70. The system of claim 69 wherein only one camera captures images of the golf ball following impact by a golf club.

71. The system of claim 69 wherein the ball includes only one stripe.

72. The system of claim 69, wherein the processor is further for determining three-dimensional velocity of the ball following impact based on the position and dimensions of the ball in said images.

73. The system of claim 72 wherein said processor is further for determining said three-dimensional velocity independent of characteristics of the stripe on said images of the ball.

74. The system of claim 69 wherein said processor calculates a linear extrapolation of said marking in at least two of said images, and calculates backspin on said ball based on a comparison of said linear extrapolations.

75. The system of claim 69 wherein said processor calculates sidespin on said ball based in part on curvatures of said marking on said images.

76. The system of claim 69 wherein the processor is further for determining three-dimensional displacement of the ball following impact based on the position and dimensions of the ball in said images.

77. The apparatus of claim 69 said at least one characteristic further includes orientation of said stripe.

* * * * *